US010167710B2

(12) United States Patent
Ghasripoor et al.

(10) Patent No.: US 10,167,710 B2
(45) **Date of Patent: *Jan. 1, 2019**

(54) PRESSURE EXCHANGE SYSTEM WITH MOTOR SYSTEM

(71) Applicant: Energy Recovery, Inc., San Leandro, CA (US)

(72) Inventors: Farshad Ghasripoor, Berkeley, CA (US); Jeremy Grant Martin, Oakland, CA (US); Alexander Patrick Theodossiou, San Francisco, CA (US)

(73) Assignee: Energy Recovery, Inc., San Leandro, CA (US)

( * ) Notice: Subject to any disclaimer, the term of this patent is extended or adjusted under 35 U.S.C. 154(b) by 682 days.

This patent is subject to a terminal disclaimer.

(21) Appl. No.: 14/684,118

(22) Filed: Apr. 10, 2015

(65) Prior Publication Data

US 2015/0292310 A1 Oct. 15, 2015

Related U.S. Application Data

(60) Provisional application No. 61/978,097, filed on Apr. 10, 2014.

(51) Int. Cl.
*F04F 13/00* (2009.01)
*E21B 43/26* (2006.01)
*E21B 43/267* (2006.01)

(52) U.S. Cl.
CPC ..... *E21B 43/26* (2013.01); *E21B 43/267* (2013.01); *F04F 13/00* (2013.01)

(58) Field of Classification Search
CPC ..... F04F 13/00; E21B 43/26; E21B 43/267
USPC ..... 417/64
See application file for complete search history.

(56) References Cited

U.S. PATENT DOCUMENTS

| | | | | |
|---|---|---|---|---|
| 3,431,747 | A * | 3/1969 | Hashemi | B01D 61/06 417/339 |
| 4,887,942 | A | 12/1989 | Hauge | |
| 9,739,128 | B2 * | 8/2017 | Ghasripoor | E21B 43/26 |
| 2007/0137170 | A1 * | 6/2007 | Bross | F04F 13/00 60/39.45 |
| 2007/0145751 | A1 * | 6/2007 | Roos | F01D 15/10 290/52 |
| 2009/0185917 | A1 | 7/2009 | Andrews | |
| 2009/0301719 | A1 | 12/2009 | Bull et al. | |
| 2010/0014997 | A1 | 1/2010 | Ruiz de Olmo | |

(Continued)

FOREIGN PATENT DOCUMENTS

| | | | |
|---|---|---|---|
| CN | 101865191 A | | 10/2010 |
| EP | 0 151 407 | * | 1/1985 |

(Continued)

OTHER PUBLICATIONS

PCT International Search Report and Written Opinion; Application No. PCT/US2015/025469; dated Jun. 30, 2015; 13 pages.

(Continued)

*Primary Examiner* — Charles Freay
(74) *Attorney, Agent, or Firm* — Fletcher Yoder, P.C.

(57) ABSTRACT

A system including a rotary isobaric pressure exchanger (IPX) configured to exchange pressures between a first fluid and a second fluid, and a motor system coupled to the hydraulic energy transfer system and configured to power the hydraulic energy transfer system.

15 Claims, 8 Drawing Sheets

(56) References Cited

U.S. PATENT DOCUMENTS

| | | | | |
|---|---|---|---|---|
| 2010/0043409 | A1* | 2/2010 | Naydenov | F02D 41/3082 60/287 |
| 2012/0070316 | A1 | 3/2012 | Glitz et al. | |
| 2013/0183167 | A1* | 7/2013 | Werner | F04B 49/022 417/53 |
| 2016/0032691 | A1* | 2/2016 | Richter | E21B 43/26 166/250.01 |
| 2016/0233814 | A1* | 8/2016 | Okamoto | H02P 6/00 |
| 2017/0051762 | A1* | 2/2017 | Ghasripoor | E21B 43/26 |

FOREIGN PATENT DOCUMENTS

| | | | |
|---|---|---|---|
| EP | 0298097 | B1 | 8/1992 |
| JP | H01502208 | A | 8/1989 |
| JP | 2011190802 | A | 9/2011 |

OTHER PUBLICATIONS

Canadian Office Action; Application No. CA 2,944,791; dated Jan. 17, 2018; 4 pages.
Unofficial Translation of Russian Office Action; Application No. RU 2016144205; dated Jan. 17, 2018; 13 pages.
Unofficial Translation of Japanese Office Action; Application No. JP 2016-561610; dated Feb. 15, 2018; 16 pages.
Application No. 2016-561610; Unofficial Translation of JP Office Action dated Oct. 24, 2017, 15 pages.

* cited by examiner 40
42
44
46
48
50
52
54
56
58
60
62
64
66
68
70
72
74
76
78
80
82
84
86
88
90

PRESSURE EXCHANGE SYSTEM WITH MOTOR SYSTEM

CROSS REFERENCE TO RELATED APPLICATION

This application claims priority to and benefit of U.S. Provisional Patent Application No. 61/978,097, entitled "Pressure Exchange System with Motor System," filed Apr. 10, 2014, which is herein incorporated by reference in its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Well completion operations in the oil and gas industry often involve hydraulic fracturing (often referred to as fracking or fracing) to increase the release of oil and gas in rock formations. Hydraulic fracturing involves pumping a fluid (e.g., frac fluid) containing a combination of water, chemicals, and proppant (e.g., sand, ceramics) into a well at high pressures. The high pressures of the fluid increases crack size and crack propagation through the rock formation to release oil and gas, while the proppant prevents the cracks from closing once the fluid is depressurized. Fracturing operations use high-pressure pumps to increase the pressure of the frac fluid. Unfortunately, the proppant in the frac fluid may interfere with the operation of the rotating equipment. In certain circumstances, the solids may slow or prevent the rotating components from rotating.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
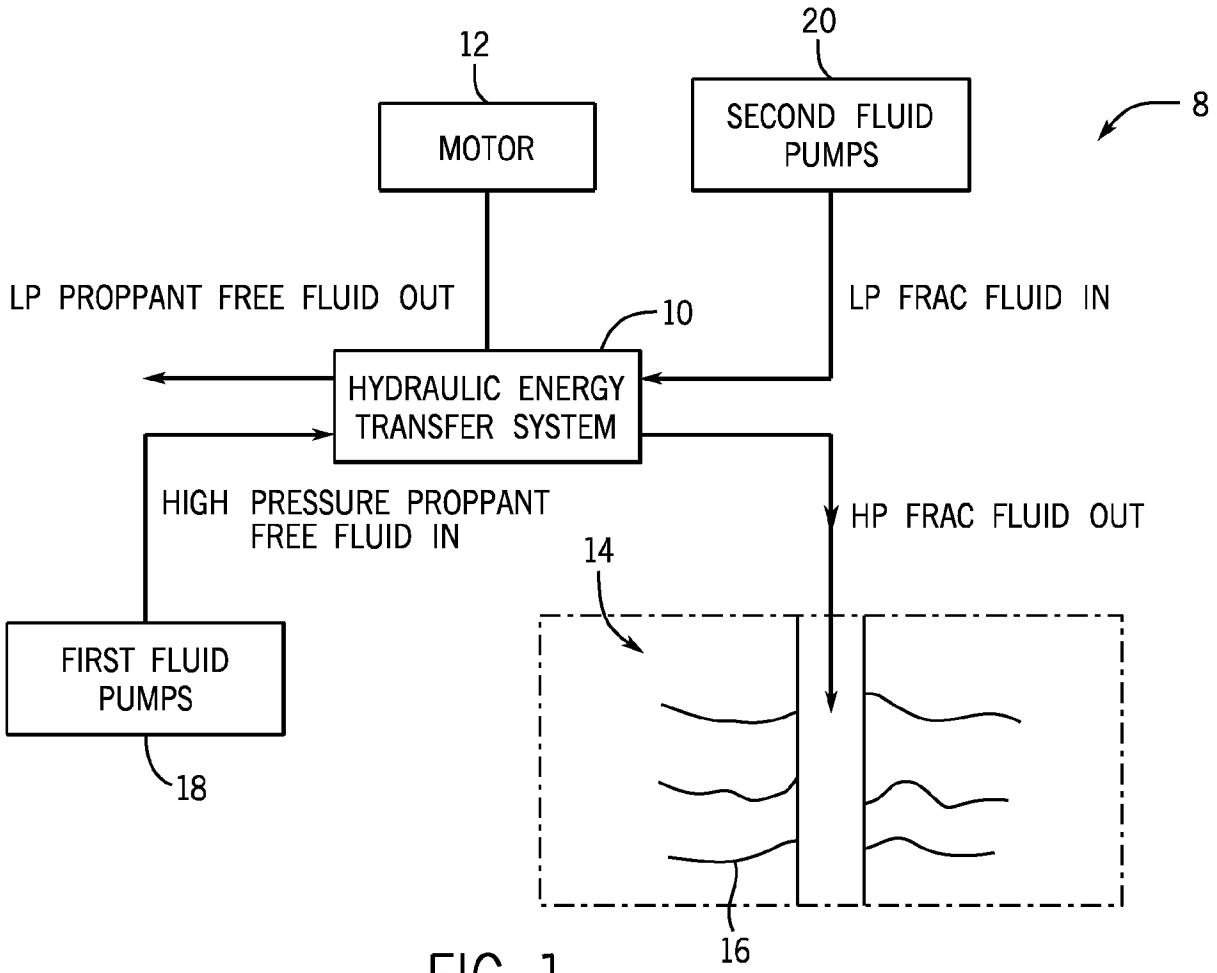
FIG. 1 is a schematic diagram of an embodiment of a hydraulic energy transfer system with a motor system.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As discussed in detail below, the frac system or hydraulic fracturing system includes a hydraulic energy transfer system that transfers work and/or pressure between a first fluid (e.g., a pressure exchange fluid, such as a substantially proppant free fluid) and a second fluid (e.g., frac fluid, such as a proppant-laden fluid). For example, the first fluid may be at a first pressure between approximately 5,000 kPa to 25,000 kPa, 20,000 kPa to 50,000 kPa, 40,000 kPa to 75,000 kPa, 75,000 kPa to 100,000 kPa or greater than a second pressure of the second fluid. In operation, the hydraulic energy transfer system may or may not completely equalize pressures between the first and second fluids. Accordingly, the hydraulic energy transfer system may operate isobarically, or substantially isobarically (e.g., wherein the pressures of the first and second fluids equalize within approximately +/−1, 2, 3, 4, 5, 6, 7, 8, 9, or 10 percent of each other).

The hydraulic energy transfer system may also be described as a hydraulic protection system a, hydraulic buffer system, or a hydraulic isolation system, because it blocks or limits contact between a frac fluid and various hydraulic fracturing equipment (e.g., high-pressure pumps), while still exchanging work and/or pressure between the first and second fluids. By blocking or limiting contact between various pieces of hydraulic fracturing equipment and the second fluid (e.g., proppant containing fluid), the hydraulic energy transfer system reduces abrasion and wear, thus increasing the life and performance of this equipment (e.g., high-pressure pumps). Moreover, the hydraulic energy transfer system may enable the frac system to use less expensive equipment in the fracturing system, for example, high-pressure pumps that are not designed for abrasive fluids (e.g., frac fluids and/or corrosive fluids). In some embodiments, the hydraulic energy transfer system may be a rotating isobaric pressure exchanger (e.g., rotary IPX). Rotating isobaric pressure exchangers may be generally defined as devices that transfer fluid pressure between a high-pressure inlet stream and a low-pressure inlet stream at efficiencies in excess of approximately 50%, 60%, 70%, 80%, or 90% without utilizing centrifugal technology.

In operation, the hydraulic energy transfer system transfers work and/or pressure between first and second fluids. These fluids may be multi-phase fluids such as gas/liquid flows, gas/solid particulate flows, liquid/solid particulate flows, gas/liquid/solid particulate flows, or any other multi-phase flow. For example, the multi-phase fluids may include sand, solid particles, powders, debris, ceramics, or any combination therefore. These fluids may also be non-Newtonian fluids (e.g., shear thinning fluid), highly viscous fluids, non-Newtonian fluids containing proppant, or highly viscous fluids containing proppant. To facilitate rotation, the hydraulic energy transfer system may couple to a motor system (e.g., electric motor, combustion engine, hydraulic motor, pneumatic motor, and/or other rotary drive). In operation, the motor system enables the hydraulic energy transfer system to rotate with highly viscous and/or fluids that have solid particles, powders, debris, etc. For example, the motor system may facilitate startup with highly viscous or particulate laden fluids, which enables a rapid start of the hydraulic energy transfer system. The motor system may also provide additional force that enables the hydraulic energy transfer system to grind through particulate to maintain a proper operating speed (e.g., rpm) with a highly viscous/particulate laden fluid. In some embodiments, the motor system may also facilitate more precise mixing between fluids in hydraulic energy transfer system, by controlling an operating speed.

FIG. 1 is a schematic diagram of an embodiment of a frac system 8 (e.g., fluid handling system) with a hydraulic energy transfer system 10 coupled to a motor system 12. As explained above, the motor system 12 facilitates rotation of the hydraulic energy transfer system 10 when using highly viscous and/or particulate laden fluids. For example, during well completion operations the frac system 8 pumps a pressurized particulate laden fluid that increases the release of oil and gas in rock formations 14 by propagating and increasing the size of cracks 16. In order to block the cracks 16 from closing once the frac system 8 depressurizes, the frac system 8 uses fluids that have solid particles, powders, debris, etc. that enter and keep the cracks 16 open.

In order to pump this particulate laden fluid into the well, the frac system 8 may include one or more first fluid pumps 18 and one or more second fluid pumps 20 coupled to the hydraulic energy transfer system 10. For example, the hydraulic energy transfer system 10 may be a rotary IPX. In operation, the hydraulic energy transfer system 10 transfers pressures without any substantial mixing between a first fluid (e.g., proppant free fluid) pumped by the first fluid pumps 18 and a second fluid (e.g., proppant containing fluid or frac fluid) pumped by the second fluid pumps 20. In this manner, the hydraulic energy transfer system 10 blocks or limits wear on the first fluid pumps 18 (e.g., high-pressure pumps), while enabling the frac system 8 to pump a high-pressure frac fluid into the well 14 to release oil and gas. In order to operate in corrosive and abrasive environments, the hydraulic energy transfer system 10 may be made from materials resistant to corrosive and abrasive substances in either the first and second fluids. For example, the hydraulic energy transfer system 10 may be made out of ceramics (e.g., alumina, cermets, such as carbide, oxide, nitride, or boride hard phases) within a metal matrix (e.g., Co, Cr or Ni or any combination thereof) such as tungsten carbide in a matrix of CoCr, Ni, NiCr or Co.

Figure 2:
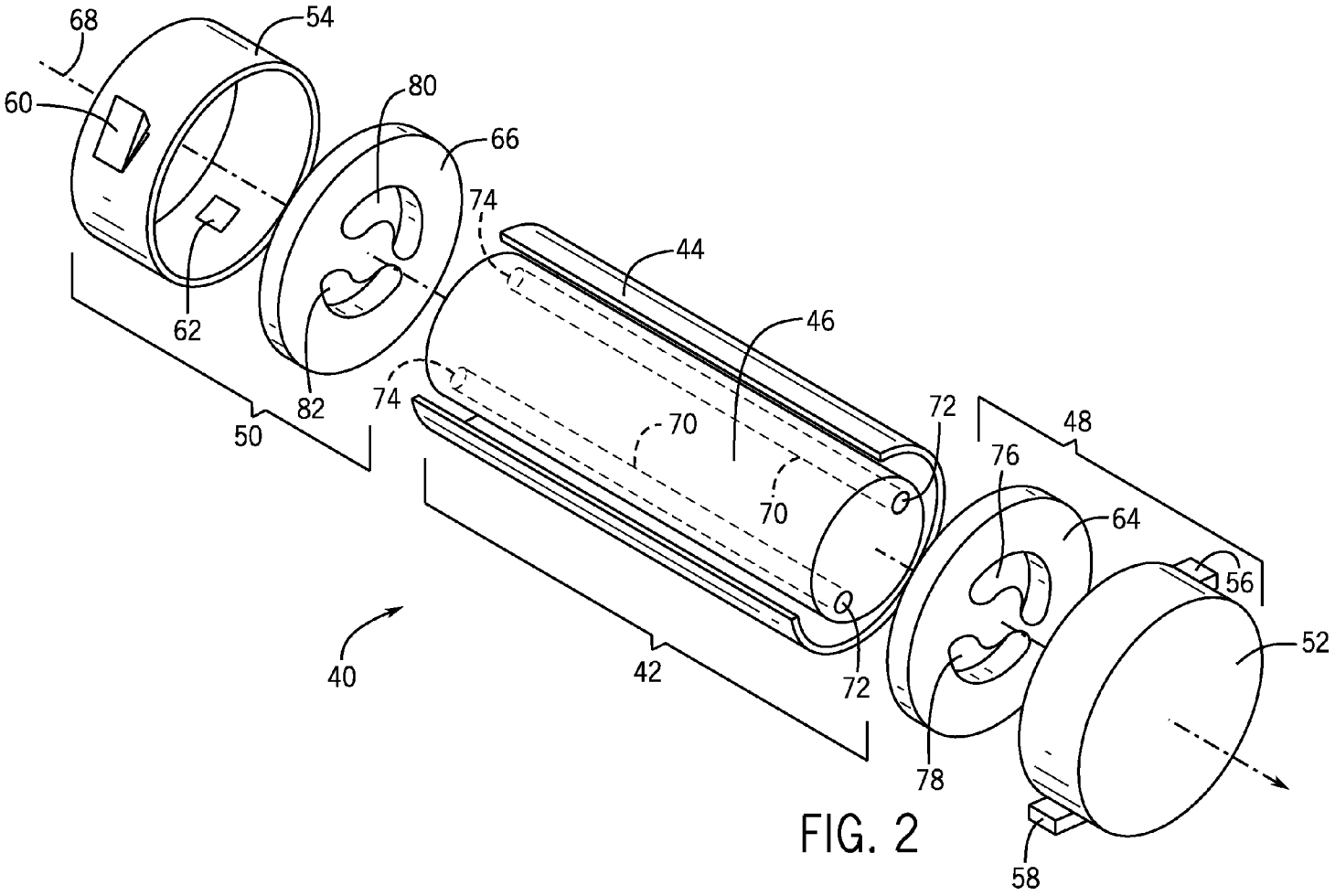
FIG. 2 is an exploded perspective view of an embodiment of a rotary IPX.

FIG. 2 is an exploded perspective view of an embodiment of a rotary isobaric pressure exchanger 40 (rotary IPX) capable of transferring pressure and/or work between first and second fluids (e.g., proppant free fluid and proppant laden fluid) with minimal mixing of the fluids. The rotary IPX 40 may include a generally cylindrical body portion 42 that includes a sleeve 44 (e.g., rotor sleeve) and a rotor 46. The rotary IPX 40 may also include two end caps 48 and 50 that include manifolds 52 and 54, respectively. Manifold 52 includes respective inlet and outlet ports 56 and 58, while manifold 54 includes respective inlet and outlet ports 60 and 62. In operation, these inlet ports 56, 60 enabling the first and second fluids (e.g., proppant free fluid) to enter the rotary IPX 40 to exchange pressure, while the outlet ports 58, 62 enable the first and second fluids to then exit the rotary IPX 40. In operation, the inlet port 56 may receive a high-pressure first fluid, and after exchanging pressure, the outlet port 58 may be used to route a low-pressure first fluid out of the rotary IPX 40. Similarly, the inlet port 60 may receive a low-pressure second fluid (e.g., proppant containing fluid, frac fluid) and the outlet port 62 may be used to route a high-pressure second fluid out of the rotary IPX 40. The end caps 48 and 50 include respective end covers 64 and 66 disposed within respective manifolds 52 and 54 that enable fluid sealing contact with the rotor 46. The rotor 46 may be cylindrical and disposed in the sleeve 44, which enables the rotor 46 to rotate about the axis 68. The rotor 46 may have a plurality of channels 70 extending substantially longitudinally through the rotor 46 with openings 72 and 74 at each end arranged symmetrically about the longitudinal axis 68. The openings 72 and 74 of the rotor 46 are arranged for hydraulic communication with inlet and outlet apertures 76 and 78; and 80 and 82 in the end covers 52 and 54, in such a manner that during rotation the channels 70 are exposed to fluid at high-pressure and fluid at low-pressure. As illustrated, the inlet and outlet apertures 76 and 78; and 80 and 82 may be designed in the form of arcs or segments of a circle (e.g., C-shaped).

In some embodiments, a controller using sensor feedback may control the extent of mixing between the first and second fluids in the rotary IPX 40, which may be used to improve the operability of the fluid handling system. For example, varying the proportions of the first and second fluids entering the rotary IPX 40 allows the plant operator to control the amount of fluid mixing within the hydraulic energy transfer system 10. Three characteristics of the rotary IPX 40 that affect mixing are: (1) the aspect ratio of the rotor channels 70, (2) the short duration of exposure between the first and second fluids, and (3) the creation of a fluid barrier (e.g., an interface) between the first and second fluids within the rotor channels 70. First, the rotor channels 70 are generally long and narrow, which stabilizes the flow within the rotary IPX 40. In addition, the first and second fluids may move through the channels 70 in a plug flow regime with minimal axial mixing. Second, in certain embodiments, the speed of the rotor 46 reduces contact between the first and second fluids. For example, the speed of the rotor 46 may reduce contact times between the first and second fluids to less than approximately 0.15 seconds, 0.10 seconds, or 0.05 seconds. Third, a small portion of the rotor channel 70 is used for the exchange of pressure between the first and second fluids. Therefore, a volume of fluid remains in the channel 70 as a barrier between the first and second fluids. All these mechanisms may limit mixing within the rotary IPX 40. Moreover, in some embodiments, the rotary IPX 40 may be designed to operate with internal pistons that isolate the first and second fluids while enabling pressure transfer.

FIGS. 3-6 are exploded views of an embodiment of the rotary IPX 40 illustrating the sequence of positions of a single channel 70 in the rotor 46 as the channel 70 rotates through a complete cycle. It is noted that FIGS. 3-6 are simplifications of the rotary IPX 40 showing one channel 70, and the channel 70 is shown as having a circular cross-sectional shape. In other embodiments, the rotary IPX 40 may include a plurality of channels 70 with the same or different cross-sectional shapes (e.g., circular, oval, square, rectangular, polygonal, etc.). Thus, FIGS. 3-6 are simplifications for purposes of illustration, and other embodiments of the rotary IPX 40 may have configurations different from that shown in FIGS. 3-6. As described in detail below, the rotary IPX 40 facilitates pressure exchange between first and second fluids (e.g., proppant free fluid and proppant-laden fluid) by enabling the first and second fluids to briefly contact each other within the rotor 46. In certain embodiments, this exchange happens at speeds that result in limited mixing of the first and second fluids.

Figures 3, 4, 5, 6:
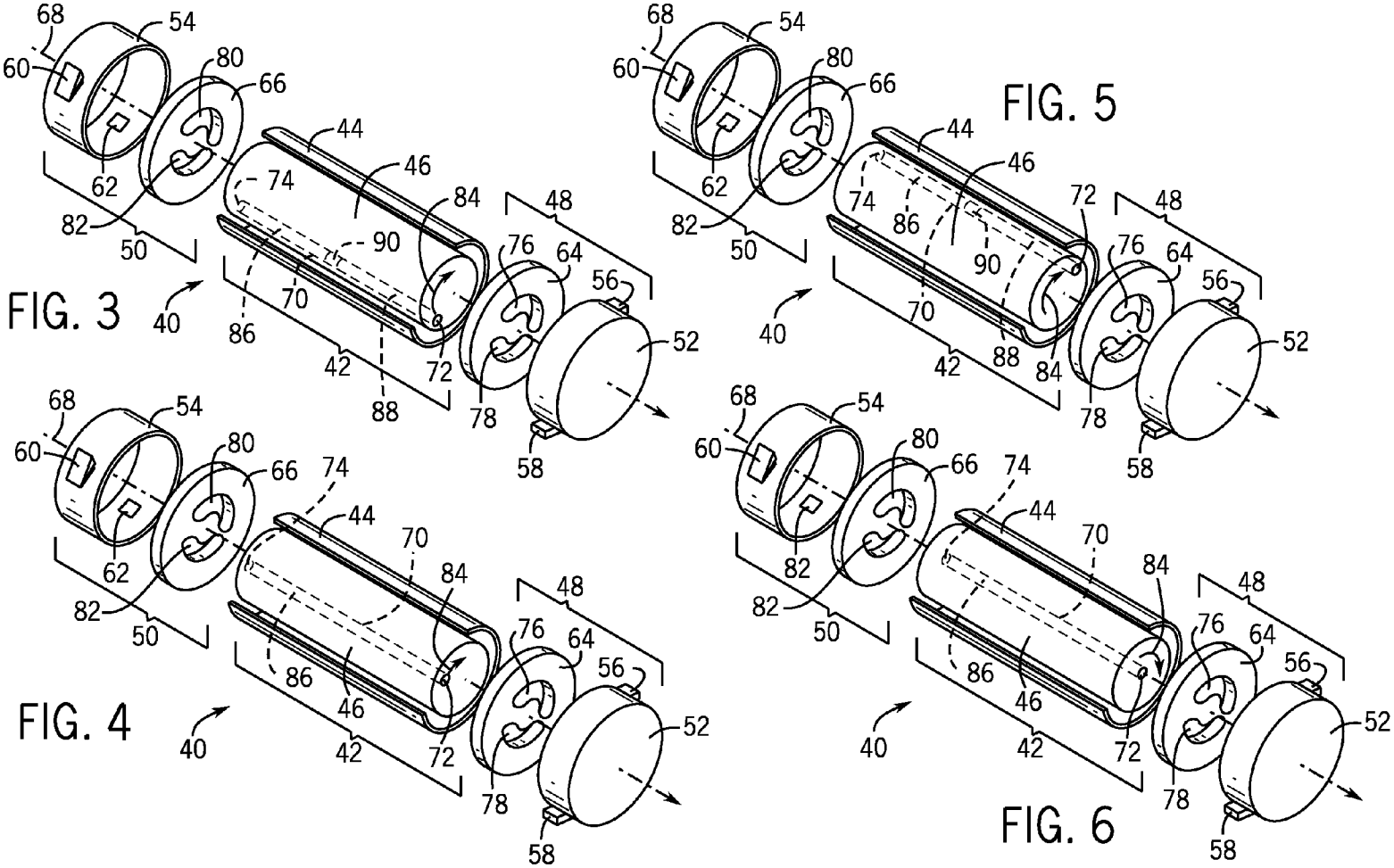
FIG. 3 is an exploded perspective view of an embodiment of a rotary IPX in a first operating position.
FIG. 4 is an exploded perspective view of an embodiment of a rotary IPX in a second operating position.
FIG. 5 is an exploded perspective view of an embodiment of a rotary IPX in a third operating position.
FIG. 6 is an exploded perspective view of an embodiment of a rotary IPX in a fourth operating position.

In FIG. 3, the channel opening 72 is in a first position. In the first position, the channel opening 72 is in fluid communication with the aperture 78 in endplate 64 and therefore with the manifold 52, while the opposing channel opening 74 is in hydraulic communication with the aperture 82 in end cover 66 and by extension with the manifold 54. As will be discussed below, the rotor 46 may rotate in the clockwise direction indicated by arrow 84. In operation, low-pressure second fluid 86 passes through end cover 66 and enters the channel 70, where it contacts the first fluid 88 at a dynamic fluid interface 90. The second fluid 86 then drives the first fluid 88 out of the channel 70, through end cover 64, and out of the rotary IPX 40. However, because of the short duration of contact, there is minimal mixing between the second fluid 86 and the first fluid 88.

In FIG. 4, the channel 70 has rotated clockwise through an arc of approximately 90 degrees. In this position, the outlet 74 is no longer in fluid communication with the apertures 80 and 82 of end cover 66, and the opening 72 is no longer in fluid communication with the apertures 76 and 78 of end cover 64. Accordingly, the low-pressure second fluid 86 is temporarily contained within the channel 70.

In FIG. 5, the channel 70 has rotated through approximately 60 degrees of arc from the position shown in FIG. 6. The opening 74 is now in fluid communication with aperture 80 in end cover 66, and the opening 72 of the channel 70 is now in fluid communication with aperture 76 of the end cover 64. In this position, high-pressure first fluid 88 enters and pressurizes the low-pressure second fluid 86 driving the second fluid 86 out of the fluid channel 70 and through the aperture 80 for use in the frac system 8.

In FIG. 6, the channel 70 has rotated through approximately 270 degrees of arc from the position shown in FIG. 6. In this position, the outlet 74 is no longer in fluid communication with the apertures 80 and 82 of end cover 66, and the opening 72 is no longer in fluid communication with the apertures 76 and 78 of end cover 64. Accordingly, the first fluid 88 is no longer pressurized and is temporarily contained within the channel 70 until the rotor 46 rotates another 90 degrees, starting the cycle over again.

Figure 7:
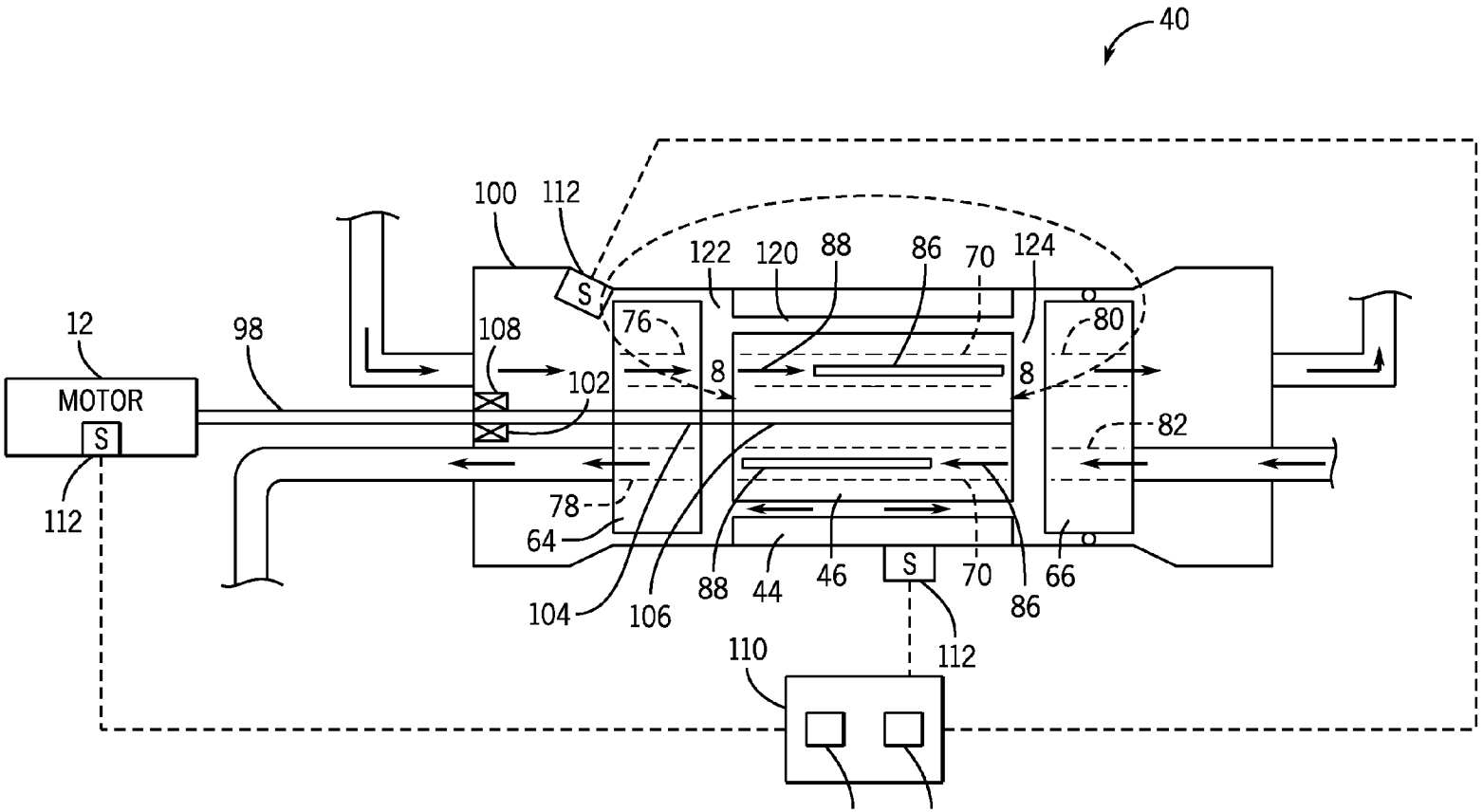
FIG. 7 is a cross-sectional view of an embodiment of a rotary IPX with a motor system.

FIG. 7 is a cross-sectional view of an embodiment of a motor system 12 (e.g., external motor system) coupled to a rotary IPX 40. As illustrated, the motor system 12 includes a shaft 98 that couples to the rotor 46 through a casing 100. Specifically, the shaft 98 extends through an aperture 102 in the casing 100, an aperture 104 in the end cover 64, and into an aperture 106 in the rotor 46. To facilitate rotation of the shaft 98, the motor system 12 may also include one or more bearings 108 that support the shaft 98. The bearings 108 may be within or without the casing 100. In some embodiments, the shaft 98 may extend completely through the rotor 46 and the end cover 66 enabling the shaft 98 to be supported by bearings 108 on opposite sides of the rotor 46.

In operation, the motor system 12 facilitates operation of the rotary IPX 40 by providing torque for grinding through particulate, maintaining the operating speed of the rotor 46, controlling the mixing of fluids within the rotary IPX 40 (e.g., changing the rotating speed of the rotor 46), or starting the rotary IPX 40 with highly viscous or particulate laden fluids. As illustrated, a controller 110 couples to the motor system 12 and one or more sensors 112 (e.g., flow, pressure, torque, rotational speed sensors, acoustic, magnetic, optical, etc.). In operation, the controller uses feedback from the sensors 112 to control the motor system 12. The controller 110 may include a processor 114 and a memory 116 that stores non-transitory computer instructions executable by the processor 114. For example, as the controller 110 receives feedback from one or more sensors 112, the processor 114 executes instructions stored in the memory 116 to control power output from the motor system 12.

The instructions stored in the memory 116 may include various operating modes for the motor system 12 (e.g., a startup mode, a speed control mode, a continuous power mode, a periodic power mode, etc.). For example, in startup mode, the controller 110 may execute instructions in the memory 116 that signals the motor system 12 to begin rotating a shaft 98. As the motor system 12 operates, the sensors 112 may provide feedback to the controller 110 that indicates whether the shaft 98 is rotating at the proper speed (e.g., rpm) or within a threshold range. When the shaft 98 reaches the desired speed or range, the controller 110 may signal the motor system 12 to stop rotating the shaft 98 enabling the first and second fluids flowing through the rotary IPX 40 to take over and provide the rotational power to the rotor 46. However, in some embodiments, the rotary IPX 40 may use the motor system 12 to periodically supplement rotation of the rotor 46 (e.g., a periodic power mode). For example, during steady state operation of the rotary IPX 40, the rotor 46 may slow as particulate enters a gap 120 between the rotor 46 and a sleeve 44, a gap 122 between the rotor 46 and first end cover 64, and/or a gap 124 between the rotor 46 and a second end cover 66. Over time, the particulate may slow the rotor 46 if the rotor 46 is unable to grind or breakup the particulate fast enough to return the rotary IPX 40 to a steady state rotating speed. In these situations, the controller 110 may receive feedback from sensors 112 indicating that the rotor 46 is slowing or outside a threshold range. The controller 110 may then signal the motor system 12 to provide power to the shaft 98 that returns the rotor 46 to a steady state rotating speed or threshold range. After returning the rotor 46 to the proper rotating speed, the controller 110 may again shutdown the motor system 12. In some embodiments, the motor system 12 may provide continuous input/control of the rotor 46 rotating speed (e.g., a continuous power mode and/or speed control mode). For example, in some embodiments, the rotary IPX 40 may operate with fluids that have mixing requirements (e.g., exposure requirements). In other words, the rotary IPX 40 may limit the exposure between the first and second fluids to block or limit the amount of the first fluid exiting the rotary IPX 40 with the second fluid through the aperture 78.

Figure 8:
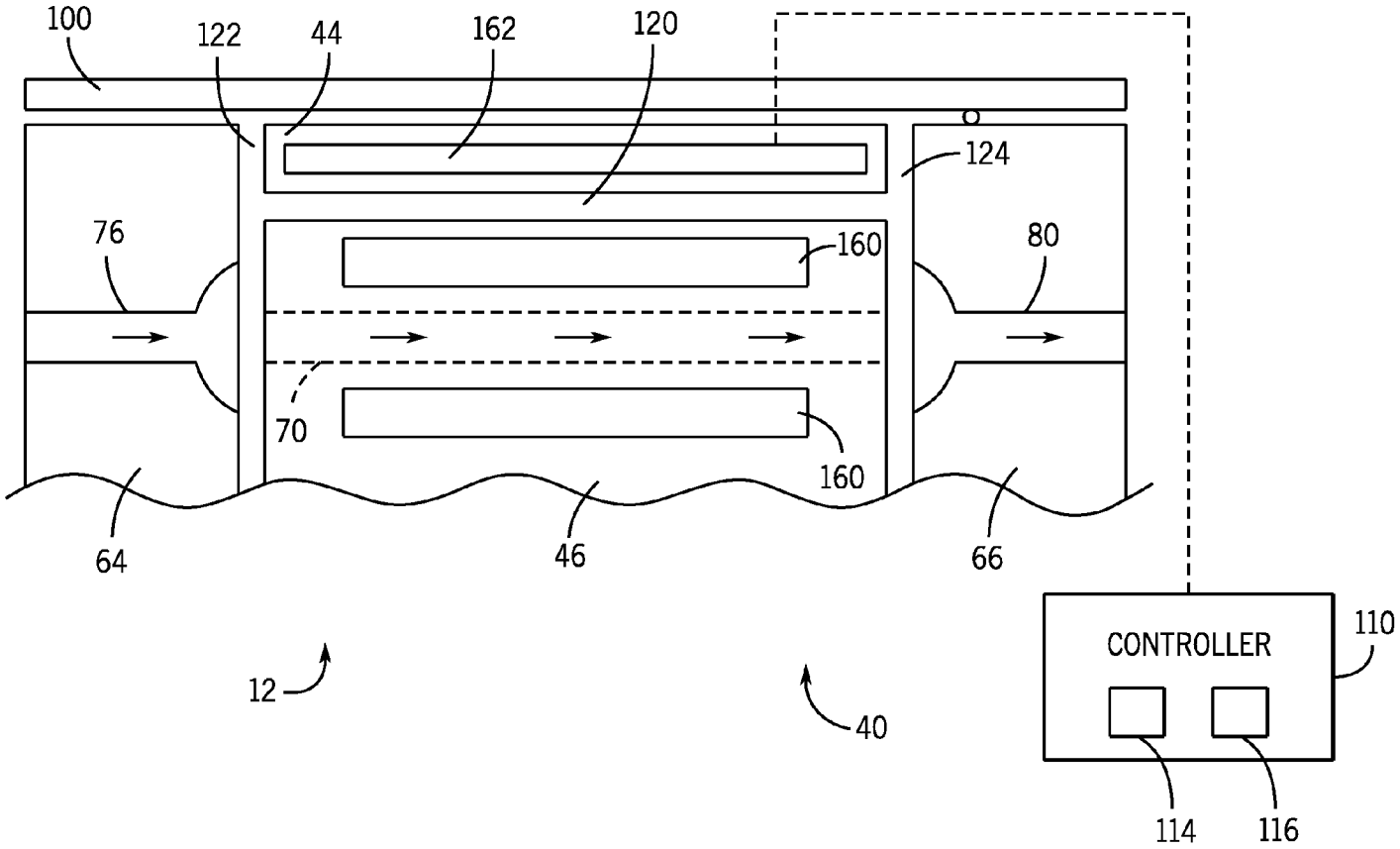
FIG. 8 is a cross-sectional view of an embodiment of a rotary IPX and a motor system within line 8-8 of FIG. 7.

FIG. 8 is a cross-sectional view of an embodiment of a rotary IPX 40 and a motor system 12 within line 8-8 of FIG. 7. In the embodiment of FIG. 8, the motor system 12 is an electric motor with permanent magnets 160 circumferentially spaced about the rotor 46 that interact with electromagnets 162 (e.g., stator windings) within the sleeve 44 (e.g., the stator). In some embodiments, the sleeve 44 may include the permanent magnets 160 while the rotor 46 includes electromagnets 162, or the rotor 46 and sleeve 44 may both include electromagnets 162. Furthermore, in some embodiments, the sleeve 44 or rotor 46 may be made out of a magnetic material (e.g., permanent magnetic material) that interacts with the electromagnets 162. As illustrated, the electromagnets 162 (e.g., stator windings) and permanent magnets 160 rest within the sleeve 44 and rotor 46 respectively to protect them from contact with fluids flowing through the rotary IPX. However, in some embodiments, the electromagnets 162 (e.g., stator windings) and/or permanent magnets 160 may be placed on external surfaces of the sleeve 44 and rotor 46.

In operation, the controller 110 controls the rotation of the rotor 46 by turning the electromagnets 162 on and off to attract and/or repel the permanent magnets 160. As the magnets 1606, 162 attract and/or repel each other they drive rotation or reduce rotation of the rotor 46. In this way, the power from the motor system 12 facilitates operation of the rotary IPX 40 by enabling the rotor 46 to grind through particulate, maintain a specific operating speed, control the mixing of fluids within the rotary IPX 40 (e.g., controlling rotating speed of the rotor 46), or starting the rotary IPX 40 with highly viscous or particulate laden fluids. In some embodiments, the controller 110 may control operation of the motor system in response to feedback from one or more sensors 112 (e.g., flow, pressure, torque, rotational speed sensors, acoustic, magnetic, optical, etc.).

Figure 9:
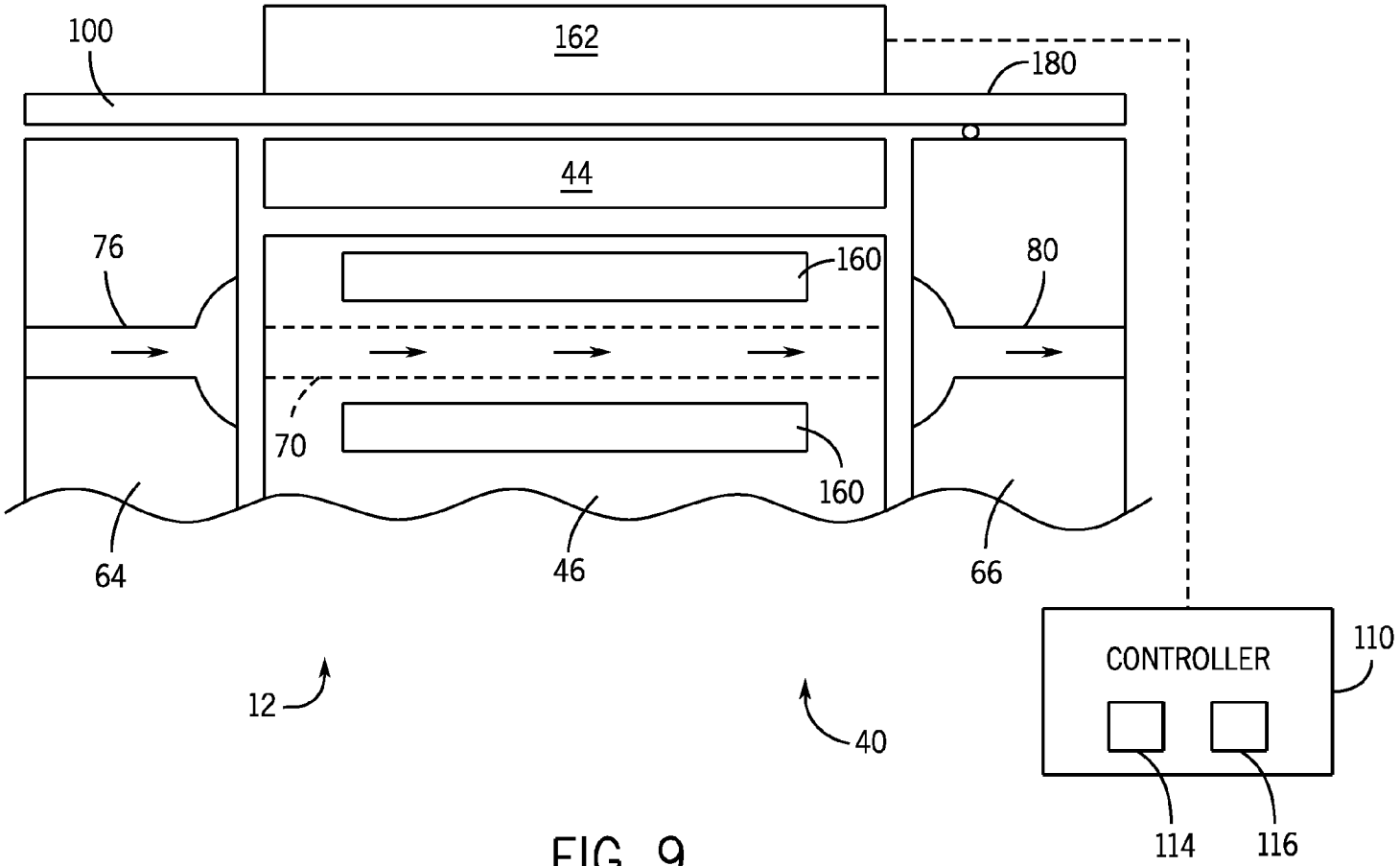
FIG. 9 is a cross-sectional view of an embodiment of a rotary IPX and a motor system within line 8-8 of FIG. 7.

FIG. 9 is a cross-sectional view of an embodiment of a rotary IPX 40 and a motor system 12 within line 8-8 of FIG. 7. In the embodiment of FIG. 9, the motor system 12 is an electric motor with permanent magnets 160 circumferentially spaced about the rotor 46 that interact with electromagnets 162 (e.g., stator windings) on an outer surface 180 of the casing 100. In some embodiments, the outer surface 180 of the rotary IPX 40 may include permanent magnets 160 while the rotor 46 includes electromagnets 162, or both the outer surface 180 of the rotary IPX 40 and the rotor 46 may have electromagnets 162. In certain embodiments, the rotor 46 may be made out of a magnetic material that enables the entire rotor 46 to interact with the electromagnets 162. By coupling the electromagnets 162 to the exterior surface 180 of the rotary IPX 40, the motor system 12 protects the electromagnets 162 from fluid flowing through the rotary IPX 40. Moreover, with the electromagnets 162 on an exterior surface 180 of the rotary IPX 40, the motor system 12 facilitates access to the electromagnets 162 for maintenance and inspection. As explained above, in operation the controller 110 controls power to the electromagnets 162 to drive rotation of the rotor 46, which enables the rotor 46 to grind through particulate, maintain a specific operating speed, control the mixing of fluids within the rotary IPX 40, or start the rotary IPX 40 with highly viscous or particulate laden fluids.

Figure 10:
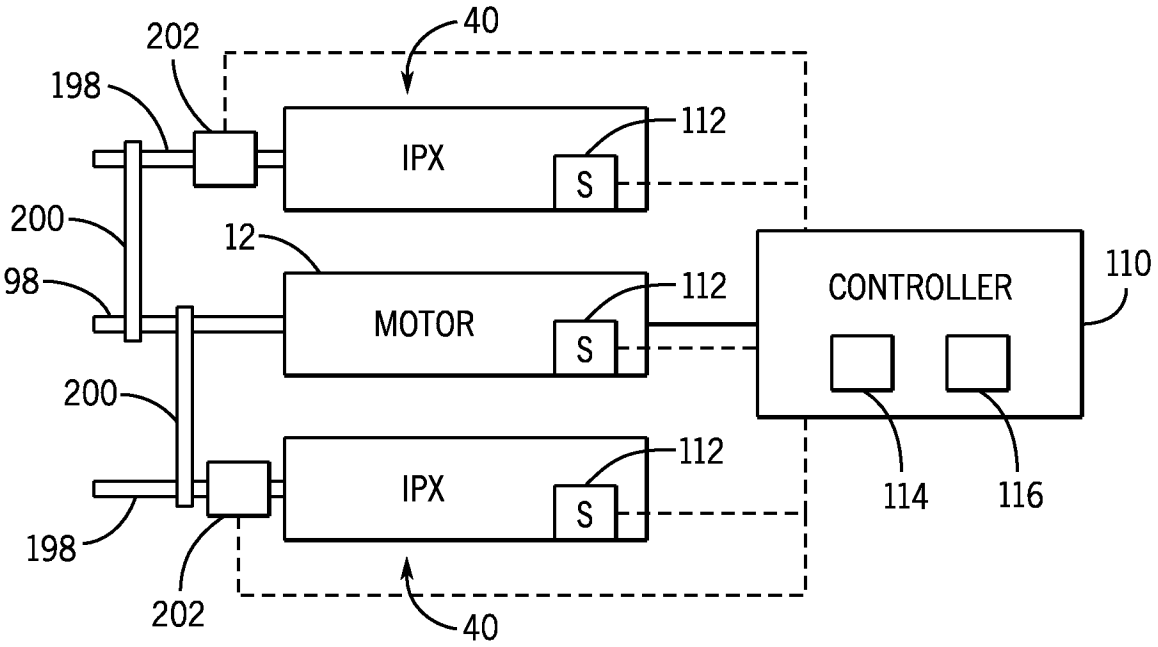
FIG. 10 is a side view of embodiment of a motor system that drives multiple rotary IPXs.

FIG. 10 is a side view of an embodiment of a motor system 12 capable of simultaneously driving multiple rotary IPXs 40. For example, each rotary IPX 40 may include a respective shaft 198 that couples to a rotor 46. The shafts 198 in turn couple to the shaft 98 of the motor system 12 using connectors 200 (e.g., belts, chains, etc.). During operation, the motor system 12 transfers rotational power from the shaft 98 to each of the rotary IPXs 40, thus driving multiple rotary IPXs 40 with one motor system 12. In the present embodiment, there are two rotary IPXs 40 coupled to the motor system 12. However, in some embodiments, there may be 1, 2, 3, 5, 10, 15, or more rotary IPXs 40 coupled to the motor system 12. For example, the rotary IPXs 40 may be circumferentially positioned about the motor enabling multiple rotary IPXs 40 to couple to a single motor system 12.

In certain embodiments, the rotary IPXs 40 may include clutches 202 that selectively connect and disconnect rotational input from the motor system 12. For example, the controller 110 may receive feedback from sensors 112 that indicates one or more of the rotary IPXs 40 are slowing (e.g., unable to grind through particulate). Accordingly, the controller 110 may close the corresponding clutches 202 enabling the motor system 12 to transfer rotational energy to the appropriate rotary IPX(s) 40. As explained above, the controller 110 controls when, how much, and for how long the motor drives rotation of the rotary IPXs 40. The controller 110 may control the motor based on sensor feedback from one rotary IPX, or from multiple rotary IPXs 40. For example, the controller 110 may start the motor system 12 when one rotary IPX is unable to grind through particulate, maintain a specific operating speed, or control the mixing of fluids within the rotary IPX 40. However, in other embodiments, the controller 110 may start the motor system 12 only when more than one rotary IPX 40 needs additional power.

Figure 11:
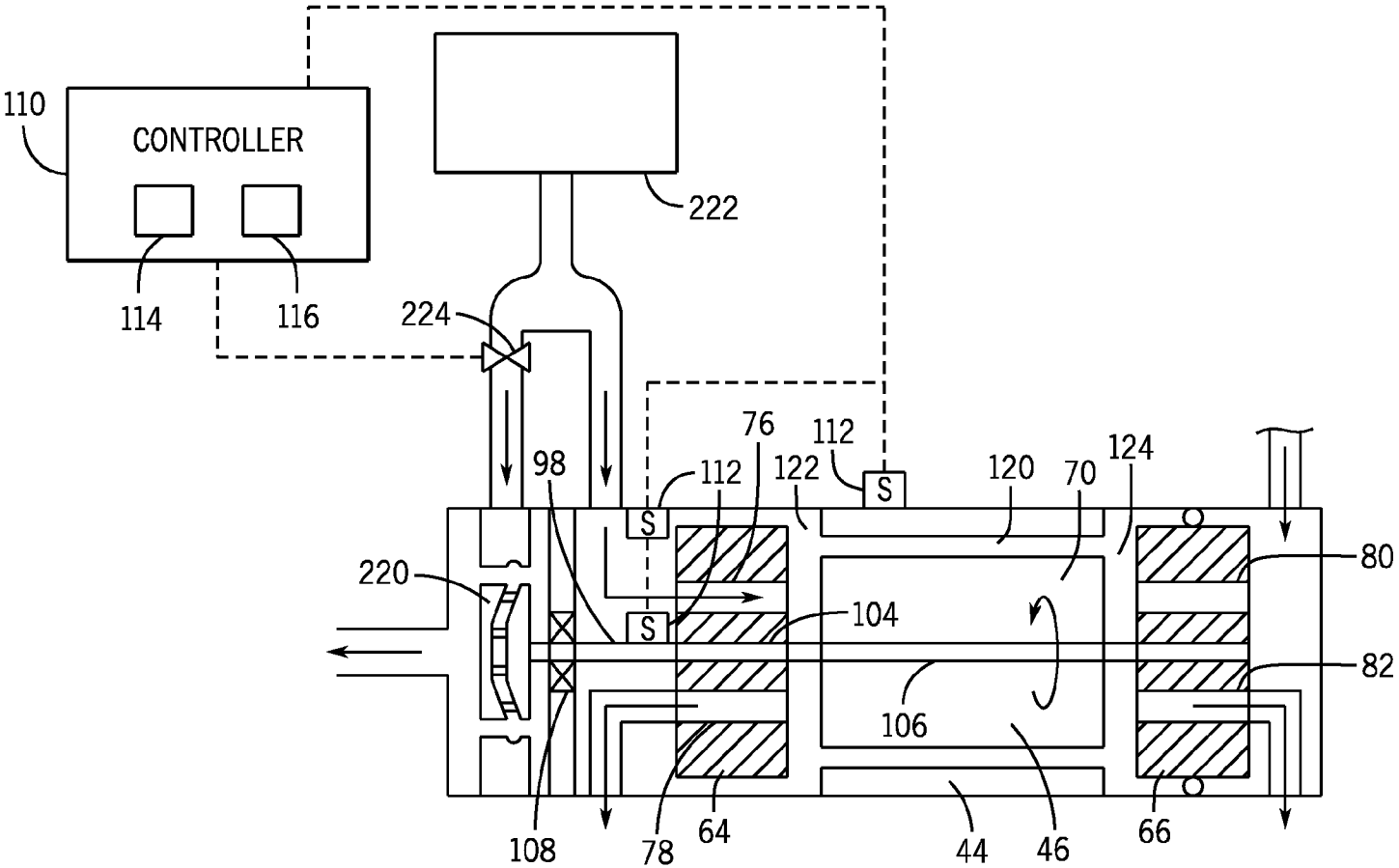
FIG. 11 is a cross-sectional side view of an embodiment of a hydraulic motor system coupled to a rotary IPX.

FIG. 11 is a cross-sectional side view of an embodiment of a motor system 12 (e.g., hydraulic motor) coupled to a rotary IPX 40. The motor system 12 facilitates operation of the rotary IPX 40 by providing torque for grinding through particulate, maintaining the operating speed of the rotary IPX 40, controlling the mixing of fluids within the rotary IPX 40, or starting the rotary IPX 40 with highly viscous or particulate laden fluids. For example, the hydraulic motor system 12 may include a hydraulic turbine 220 coupled to the rotary IPX 40 with a shaft 98. In operation, the motor system 12 receives fluid flow (e.g., high-pressure proppant free fluid) from a fluid source 222 that drives rotation of the hydraulic turbine 220 and therefore the shaft 98. The fluid source 222 may be the same fluid source used to operate the rotary IPX 40 or a different fluid source. As the shaft 98 rotates, the shaft 98 rotates the rotor 46. In some embodiments, the controller 110 may control a valve 224 in order to control fluid flow through the hydraulic turbine 220. For example, as the controller 110 receives feedback from the sensors 112 (e.g., flow, pressure, torque, rotational speed sensors, acoustic, magnetic, optical, etc.), the processor 114 executes non-transitory computer instructions stored in the memory 116 to control the opening and closing of the valve 224, thus starting and stopping the hydraulic turbine 220.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A frac system, comprising:

a hydraulic energy transfer system configured to exchange pressures between a first fluid and a second fluid, the hydraulic energy transfer system comprises:

a housing;

a rotor within the housing and configured to exchange the pressures between the first fluid and the second fluid;

a sleeve within the housing wherein the rotor is configured to rotate within the sleeve; and an electric motor system coupled to the hydraulic energy transfer system and configured to rotate the rotor, the electric motor system comprises:

a first magnet within the sleeve; and a second magnet within the rotor, wherein interaction between the first magnet and the second magnet are configured to rotate the rotor.

2. The system of claim 1, wherein the first fluid is a substantially particulate free fluid and the second fluid is a particulate laden fluid.

3. The system of claim 1, wherein the hydraulic energy transfer system comprises a rotary isobaric pressure exchanger (IPX).

4. The system of claim 1, wherein the first magnet comprises a permanent magnet or an electromagnet.

5. The system of claim 1, wherein the second magnet comprises a permanent magnet or an electromagnet.

6. The system of claim 1, comprising a controller with one or more modes of operation configured to control the electric motor system.

7. The system of claim 6, wherein the one or more modes of operation comprise at least one of a startup mode, a speed control mode, a continuous power mode, or a periodic power mode.

8. The system of claim 6, comprising a sensor configured to detect whether the hydraulic energy transfer system is rotating within a threshold range, wherein the controller couples to the sensor and controls the electric motor system in response to feedback from the sensor.

9. A system, comprising:

a rotary isobaric pressure exchanger (IPX) configured to exchange pressures between a first fluid and a second fluid, the rotary IPX comprises:

a housing;

a rotor within the housing and configured to exchange the pressures between the first fluid and the second fluid;

a sleeve within the housing wherein the rotor is configured to rotate within the sleeve; and an electric motor system coupled to the rotary IPX and configured to rotate the rotor, the electric motor system comprises:

a first magnet coupled to an exterior surface of the housing; and a second magnet within the rotor, wherein interaction between the first magnet and the second magnet are configured to rotate the rotor.

10. The system of claim 9, wherein the first fluid is a substantially particulate free fluid and the second fluid is a particulate laden fluid.

11. The system of claim 9, wherein the first magnet and the second magnet comprise permanent magnets and/or electromagnets.

12. The system of claim 9, comprising a controller with one or more modes of operation configured to control the electric motor system, wherein the one or more modes of operation comprise at least one of a startup mode, a speed control mode, a continuous power mode, or a periodic power mode.

13. A method, comprising:

monitoring rotation of a rotor in a rotary isobaric pressure exchanger (IPX), the rotor being configured to exchange pressure between a first fluid and a second fluid;

detecting a condition when the rotor is rotating outside of a threshold range; and operating a motor system coupled to the rotary IPX in response to the condition, wherein operating the motor system in response to the condition comprises operating a first magnet within a sleeve of the rotary IPX and a second magnet within the rotor of the rotary IPX to control rotation of the rotor.

14. The method of claim 13, wherein monitoring rotation of the rotor comprises monitoring a flow sensor, a pressure sensor, a torque sensor, a rotational speed sensor, an acoustic sensor, a magnetic sensor, or an optical sensor with a controller.

15. The method of claim 13, wherein operating the motor system in response to the condition comprises selecting additional modes of operation, and wherein the additional modes of operation comprise at least one of a speed control mode, a continuous power mode, or a periodic power mode.

* * * * *